United States Patent [19]

Kendrick

[11] 4,120,132

[45] Oct. 17, 1978

[54] METAL ROOFING SHINGLE AND HOLDING STRIP THEREFOR

[76] Inventor: John W. Kendrick, P.O. Box 441, Gulfport, Miss. 39501

[21] Appl. No.: 663,439

[22] Filed: Mar. 3, 1976

[51] Int. Cl.[2] ..... E04D 1/28; E04D 1/34

[52] U.S. Cl. ..... 52/478; 52/539; 52/541; 52/553

[58] Field of Search ..... 52/276, 541, 529, 530, 52/556, 536, 539, 553, 478

[56] References Cited

U.S. PATENT DOCUMENTS

| | | | |
|---|---|---|---|
| 716,225 | 12/1902 | Hansen | 52/541 |
| 1,438,302 | 12/1922 | Fredericksen | 52/530 X |
| 2,196,420 | 4/1940 | Matthews | 52/530 |
| 2,231,008 | 2/1941 | Ochs | 52/556 X |
| 2,264,546 | 12/1941 | Ochs | 52/521 |
| 2,297,353 | 9/1942 | Goss et al. | 52/539 X |

*Primary Examiner*—Alfred C. Perham
*Attorney, Agent, or Firm*—Mason, Mason & Albright

[57] ABSTRACT

A metal roofing shingle having a main body portion of a generally trapezoidal configuration. A holding strip is utilized for supporting and backing the shingle, when applied to a roof. The entire structure is waterproof, easy to install and extremely durable. The trapezoidal shape of the shingle body provides a unique arrangement whereby moisture which may be driven thereunder by rain storms is readily drained.

7 Claims, 9 Drawing Figures

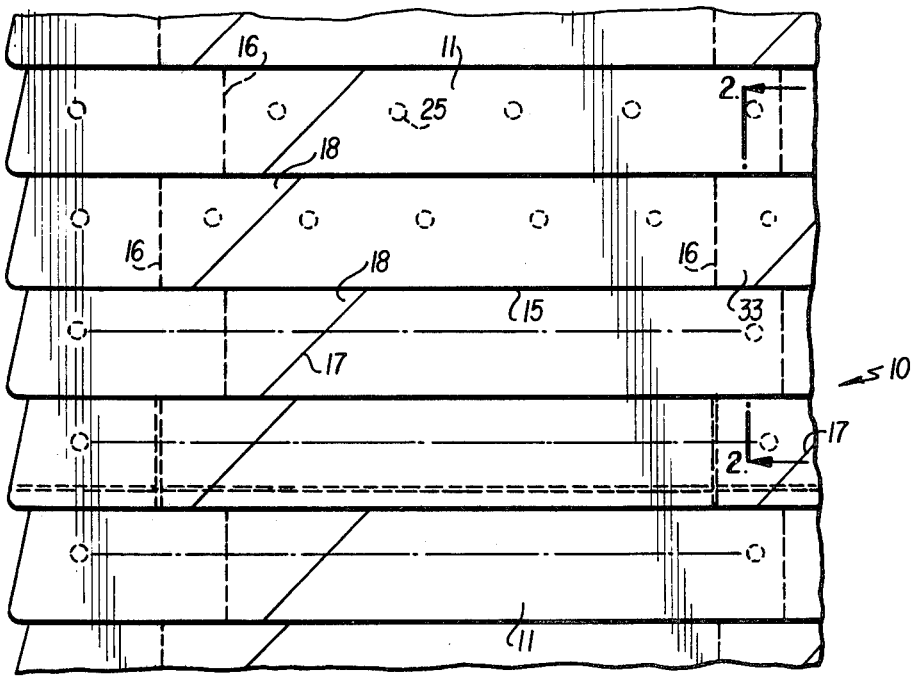
FIG. 1
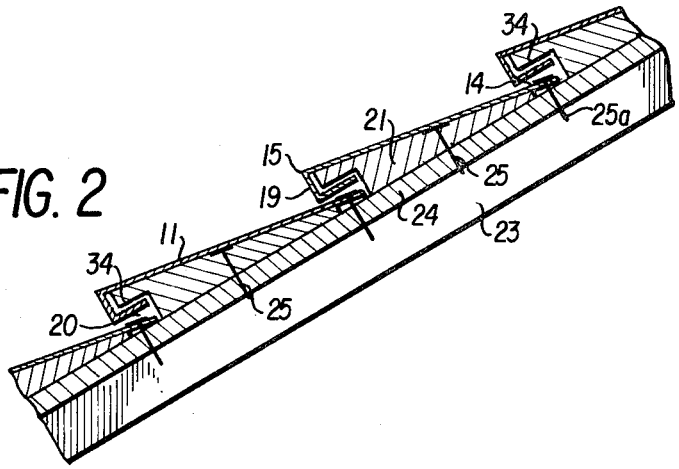
FIG. 2
FIG. 5
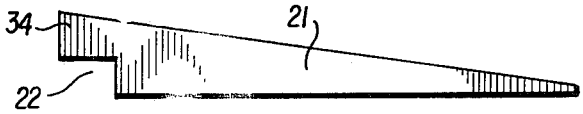
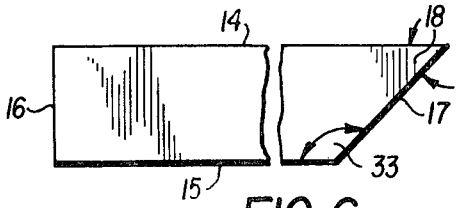
FIG. 6

FIG. 3
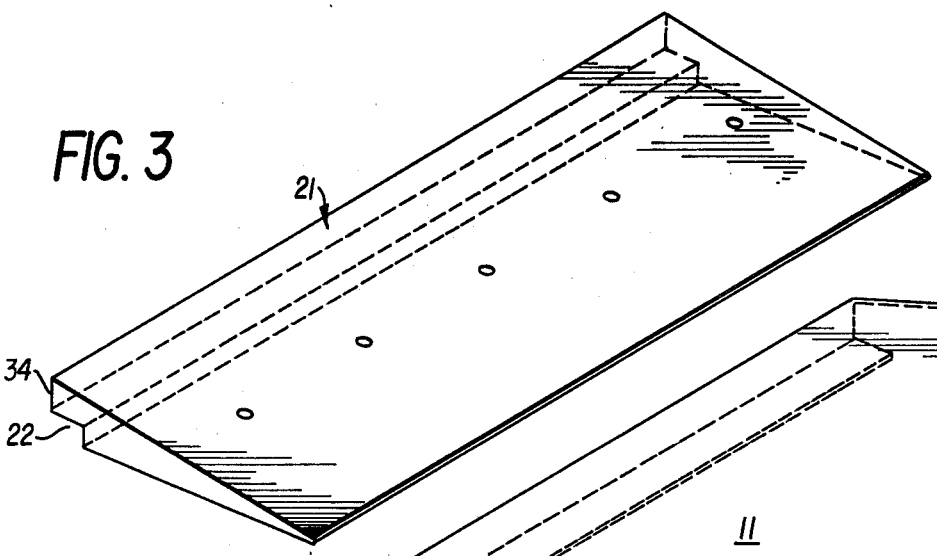
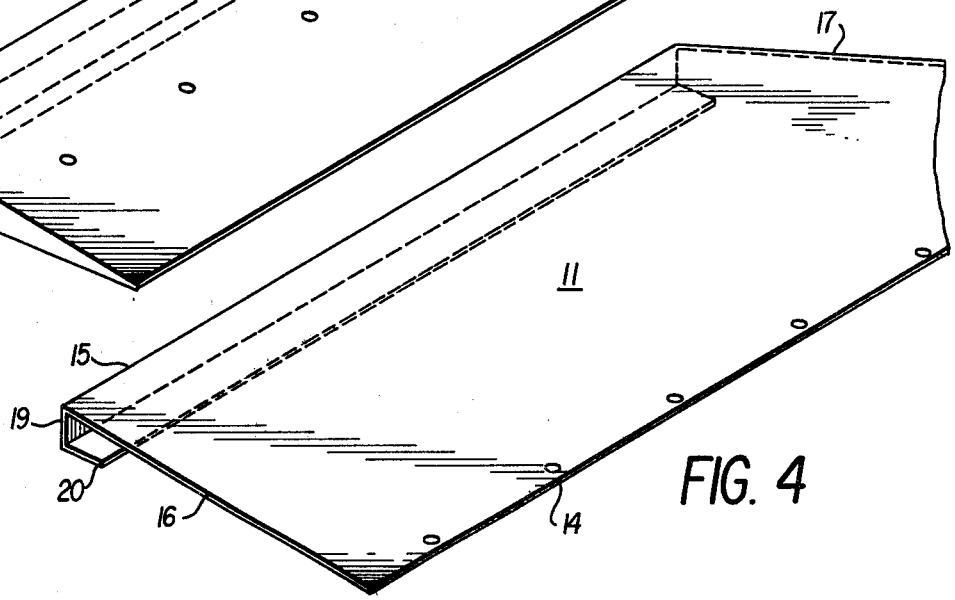
FIG. 4
FIG. 7
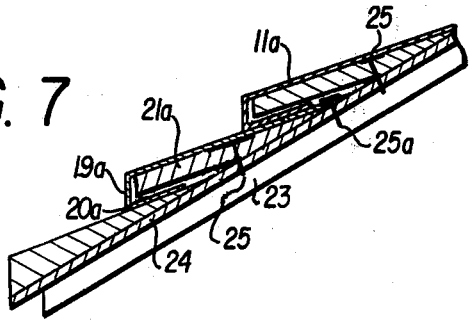
FIG. 8
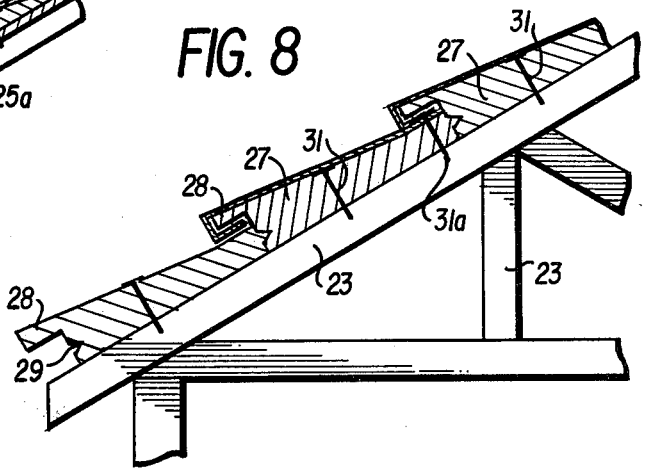
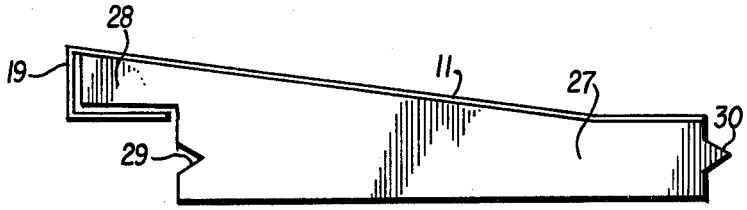
FIG. 9

METAL ROOFING SHINGLE AND HOLDING STRIP THEREFOR

BACKGROUND OF THE INVENTION

An essential part of every building structure is an enclosing top surface, or roof. The basic function of all roofs is to provide a closing or sealing surface which prevents entry of wind, rain, snow, and cold into the building. Traditionally, roofs have been made of varied materials with correspondingly differing effectiveness. For sloped roofs, various types of overlaping shingles are generally employed with the down-slope overlap portion exceeding in width the exposed portion with vertical joints between shingle disposed above a monpenetrable shingle surface. Unfortunately, this requirement generally dictates the relatively thin thickness, and to some extent, the size and shape of the shingles and discourages the use of structurally strong construction arrangements. For example in the U.S. Pat. No. 2,264,546, to Oches, issued Dec. 2, 1941, a surface covering structure is disclosed which comprises a base member and a covering member each of which may be of diverse materials. However, the overlapping areas are small and consequently special provision, such as a backing strip, must be made to seal between adjacent members at the same level. In the Goss et al. patent, U.S. Pat. No. 2,297,353, issued Sept. 29, 1942, beveled siding is manufactured from scraps of material which are ordinarily wasted, but are effectively and securely united by a special tongue and groove arrangement whereby they compare favorably with long length lumber. In U.S. Pat. No. 2,519,950, issued Aug. 22, 1950, to Abraham there is disclosed an insulated clapboard siding comprising fiber board faced with mineral granules applied thereto. U.S. Pat. No. 2,624,920, issued Jan. 13, 1953, to Anderson relates to wooden shingles which are secured to a wooden backing and have interlocking tongue and groove connections. Two layers are employed, one layer being staggered relative to the other.

In a sloped roof, the connection of adjacent members becomes more critical due to the increasingly direct exposure to the effects of rain and snow with the consequent problems increasing as the slope decreases. Thus, despite structural advantages possible, it is seldom that vertical surface coverings as exemplified in the Oches patent are utilized for a sloping roof.

SUMMARY OF THE INVENTION

My invention is directed principally to the provision of a roofing shingle of substantially permanent character and relatively strong construction. The invention employs unique shingle members of metal such as copper, galvanized iron, aluminum or a combination of metals such as copper and lead. Such metal shingles are advantageously combined with a holding strip or anchor, the holding strip being made of wood, light weight concrete, insulation board plastic, styrofoam, etc.

The combination may, in the assembly of one form of my holding strip, be placed immediately upon the roof joists with the shingles superimposed thereover. Prevention of leakage between adjacent shingles at the same level is achieved by a biased overlap of the metal portion of the combination, the holding strip immediately under the biased overlap being solid.

Other objects, adaptabilities and capabilities of the invention will be understood by those skilled in the art from the description of the invention which follows, reference being had to the accompanying drawings, in which:

BRIEF DESCRIPTION OF THE DRAWINGS

FIG. 1 is a front view of a portion of a roof covered in accordance with my invention;

FIG. 2 is an enlarged section taken on line 2—2 of FIG. 1;

FIG. 3 is a perspective view of a holding strip;

FIG. 4 is a perspective view of a metal shingle;

FIG. 5 is a side view of a holding strip;

FIG. 6 is a plan illustration of a metal shingle with an intermediate portion removed and showing the trapezoidal configuration thereof;

FIG. 7 is a side view of a metal shingle installed on a modified holding strip and the entire finished product installed on a roof where the sheeting has been previously applied;

FIG. 8 is a side view similar to that of FIG. 7, of a metal shingle installed on a combination sheeting and holding strip, wherein the finished product is applied directly to the roof rafters without the use of separate sheeting;

FIG. 9 is a side view of a combination sheeting and holding strip and of the type shown in FIG. 8.

DESCRIPTION OF THE PREFERRED EMBODIMENTS

Referring to FIG. 1 of the drawings, a corner of a completed roof structure, generally designated by reference numeral 10, comprises a plurality of shingle body members 11 arranged in both horizontal and vertical overlapped relationships, as will be explained in greater detail hereafter. Each shingle body member is of generally trapezoidal configuration, i.e., the upper edge 14 and the lower edge 15 are parallel, whereas one of the vertical edges 16 is substantially perpendicular thereto and the other edge 17 is biased at substantially 45° relative to the upper edge, as is designated by reference numeral 18. The edge 17 is at an obtuse angle to the lower edge 15 of the same shingle body member. Also, lower edge 15 is bent at a substantially right angle to provide a ledge 19, and then further bent to provide a lip 20 extending substantially parallel to the face side of the shingle body member. Either end of shingle body member may be angled to the normal, but preferably not both ends.

The holding strip or anchor 21 is rectangular as seen in plan and is shown in enlarged detail in FIGS. 3 and 5. In crossection it is of generally wedge configuration. A recess 22 is formed at the thicker edge of the holding strip, providing a rib 34. Anchor 21 may be fashioned from wood, concrete, light weight concrete, insulation board, plastic, styrofoam, or the like. It will also be understood by those skilled in the art, that other well-known materials may be substituted.

In utilizing my invention, the conventional roof rafters 23, shown in FIG. 2, have applied thereto a covering sheeting 24. This covering sheeting spans a plurality of rafters to strengthen the roof and provide a base upon which to apply the shingle structure. Commencing with the eaves of the roof, a row or course of holding strips 21 are secured by nails 25 or the like to sheeting 24. The holding strips, it is to be noted, are butted end to end. It should also be noted that the nails penetrate only one course of holding strips. The next step is to cover the holding strips with a course of shingle body members.

This is accomplished by disposing the rebent portion or lip 20 at a level below the recess 22 of the holding strip and sliding the shingle upwardly so that the rib 34 is disposed between the face and the lip 20 of the shingle body member. Ledge 19 is not forced tightly against the bottom of the rib 34 so as to allow a certain amount of air under rib 34. The next laterally adjacent shingle body member of the course overlaps the previous one to an extent that amply assures complete coverage of the roof surface, while at the same time permitting expansion and contraction of the metal during exposure to high and low temperatures as occasioned by weather changes. The overlapping portion includes the angularly biased edge 17 of shingle body member 11. This procedure is repeated with each successive shingle of the course. The shingles are secured adjacent their upper edges to the sheeting 24 by further nails 25*a;* it being noted that such nails do not penetrate the holding strip or anchor 21. Upon completion of one course, the next course upwardly is applied in the same manner, taking care that the overlapping edges of one course do not coincide with those of the previous course. At the lateral end of each course, any excess metal shingle is cut off and the edge bent downwardly to embrace the side of the holding strip. This procedure is repeated until the entire roof surface is completed up to the ridge. A roof made in this manner is substantially hurricane proof.

During a driving rain, water may be impelled with great force at an angle other than normal to the roof surface, with the result that some of the water is forced up the incline of the roof, finds its way under the seam or overlapping edges and falls by gravity to the channel formed by the face of shingle members 11, ledge 19 and lip 20. In conventional structures this water may remain in the channel for a prolonged period of time, with no means of escape, causing damage to the sheeting and structure below. I have found that by making the shingles of trapezoidal configuration, with the obtuse angle 33 at the lower portion, an extremely important advantage is obtained. The descending water driven into the overlapped biased portions is readily discharged because there is no other channel provided in that area of the shingle for the water to follow. Also, because the ledge 19 is not tightly against the bottom of rib 34, air may circulate freely therearound and drying will occur.

The construction shown in FIG. 7 is similar to that of FIG. 2 except that recesses 22 are not provided in anchors 21*a* and shingle body members 11*a* have a somewhat different cross-sectional configuration with the lip 20*a* parallel to the face of shingle member 11*a* and ledge 19*a* is disposed at an acute angle to lip 20*a*.

In FIGS. 8 and 9, the modified combination shingles and holding strip includes the same concept insofar as the trapezoidal configuration of the shingle is concerned. In this arrangement, however, the holding strip, in addition to serving as in the above-described modification, eliminates the need for a sheeting member to be applied to the rafters. The holding strip 27, although cross-sectionally tapered, is substantially thicker in its cross-sectional dimension than that of the modification illustrated in FIGS. 2 and 5. Further, the lower edge, in addition to having a rib 28, is provided with a groove 29. The upper edge includes a tongue 30. It will be readily observed that when successive courses of these holding strips are assembled, the tongue of the lower strip mates with the groove of the upper. Nails 31 fasten the holding strips and shingles in the same manner as above described. In addition, nails 31*a* fasten the shingles to the holding strip.

In either modification, the length of the holding strip or anchor may vary in accordance with manufacturing requirements and other desired parameters. Also, the specific width of the metal shingle and holding strip, as well as the sizes of the tongues, grooves, ribs, channels and lips may be varied. The nails utilized are preferably of the type provided with spiral knulings or ribs, commonly known as "screw-type" nails, to prevent them from backing out.

The metal shingle body member and holding strip arrangement above described may be applied, if desired, directly over a conventional shingle roof.

Although the preferred embodiments of the invention are described above, it is to be understood that the inventive concepts are capable of other adaptations and modifications within the scope of the following claims.

Having thus described my invention, what I claim as new and desire to secure by Letters Patent of the United States is:

1. A metallic roofing shingle comprising a body portion of trapezoidal configuration wherein the top and bottom edges thereof are parallel and the bottom edge is of a dimension less that that of the top, a third edge thereof being substantially normal to the top and bottom edges, said bottom edge being bent and rebent to provide a channel, a holding strip disposed in backing relation to said shingle body; said holding strip being of wedge shape in cross-section, the thicker edge thereof having a rib; said rib being loosely disposed in said channel, whereby said rib is spaced from said bent and rebent edges and said channel is free to discharge moisture therein and permit circulation of air therearound.

2. A roofing shingle according to claim 1, wherein said rib is substantially continuous along the length of said holding strip.

3. A metallic shingle roof structure comprising a plurality of shingle body portions each said body portion being of trapezoidal configuration, wherein the top and bottom edges thereof are parallel and the bottom edge is of a dimension less than that of the top edge, and wherein a third edge is normal to said top and bottom edge, said plurality of body portions being substantially horizontally aligned, and wherein a fourth edge of each body portion is disposed in overlapping relation to the third edge of the laterally adjacent preceding shingle body portion, the bottom edge of each body portion being bent and rebent to provide a channel, said channels of laterally disposed body portions being in substantial alignment, a holding strip disposed in backing relation to said shingle body portion, said holding strip being of wedge shape in cross-section, the thicker edge thereof having a substantially continuous rib, said rib being disposed in said substantially aligned channels and being spaced from said bent and rebent edge parts.

4. A device according to claim 3, further comprising roof rafter members, sheeting secured to said roof rafter members, means securing said holding strip to said sheeting, means directly securing said shingle body portions adjacent said top edge to said sheeting.

5. A plurality of rows of horizontally aligned structures as defined in claim 4, wherein each succeeding row is disposed in vertically spaced overlapped relation to the preceding row commencing from the eaves of a roof, whereby at least a portion of the channel of a succeeding row overlaps the means directly securing the shingle body portion of the previous row.

6. In a roofing apparatus, a holding strip of a material taken from the class including wood, light weight concrete, insulation board and plastic; said strip comprising a longitudinal body portion of generally rectangular planar configuration and wedge-chaped cross section, the thicker edge having a rib substantially coextensive with said longitudinal body portion, a metal sheeting covering said strip including a bent portion and a rebent portion which form a channel which is adjacent to and spaced from the forward and underlying part of said rib.

7. A plurality of structures in a roofing apparatus, each structure comprising a holding strip of a material taken from the class including wood, lightweight concrete, insulation board and plastic, said strip comprising a longitudinal body portion of generally rectangular planar configuration and wedge-shaped cross-section, the thicker edge having a rib and an underlying groove substantially coextensive with said longitudinal body portion, the thinner edge having a tongue corresponding to said groove substantially coextensive with said longitudinal body portion, each said strip comprising a row in said apparatus with each succeeding row being disposed in vertically spaced overlapped relation to the proceeding row commencing from the eaves of the roof whereby the rib of a succeeding row overlaps and is substantially spaced above a portion of the previous row and the groove of the succeeding row overlaps the tongue of the previous row, each said strip having a corresponding metallic roofing shingle, each said shingle comprising a body portion of trapezoidal configuration which covers each said structure, the top and bottom edges of each said roofing shingle being parallel and the bottom edge thereof being of a dimension less than that of a top edge, a third edge of each said shingle being substantially normal to said top and bottom edges, said bottom edge of each said metallic roofing shingle being bent and rebent to provide a channel, each said roofing shingle being superimposed upon said holding strip with the rib thereof disposed in said channel spaced from said bent and rebent edges, and means being provided for securing each said holding strip and each said roofing shingle directly to the rafters of a roof structure.

* * * * *